United States Patent [19]

Anderson et al.

[11] 4,110,067

[45] Aug. 29, 1978

[54] GAS MIXER

[75] Inventors: Harold G. Anderson, Kirtland; Jeuel E. Guess, Willoughby Hills, both of Ohio

[73] Assignee: General Electric Company, Schenectady, N.Y.

[21] Appl. No.: 719,290

[22] Filed: Aug. 31, 1976

[51] Int. Cl.[2] ..... F23D 13/46

[52] U.S. Cl. ..... 431/346; 48/180 F

[58] Field of Search ..... 431/354, 346, 280; 137/597; 48/192, 180 C, 180 F

[56] References Cited

U.S. PATENT DOCUMENTS

| | | | |
|---|---|---|---|
| 330,092 | 11/1885 | Brower | 431/280 |
| 713,421 | 11/1902 | Fouche | 48/192 |
| 2,618,539 | 11/1952 | Conta et al. | 431/346 |
| 2,717,031 | 9/1955 | Damm | 48/180 F |

*Primary Examiner*—Edward G. Favors

*Attorney, Agent, or Firm*—Paul F. Wille; Lawrence R. Kempton; Frank L. Neuhauser

[57] ABSTRACT

An improved gas mixer is described in which combustible or explosive mixtures of gases are formed in a confined area on the outside surface of the mixer.

10 Claims, 6 Drawing Figures

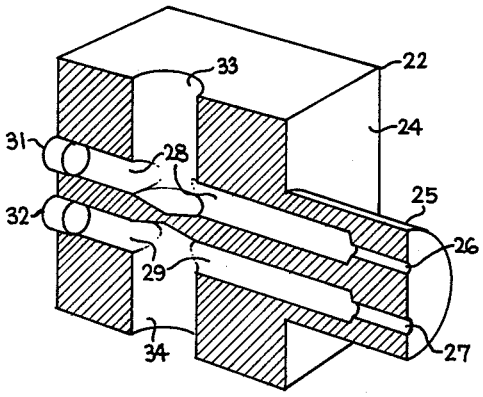
Fig. 3
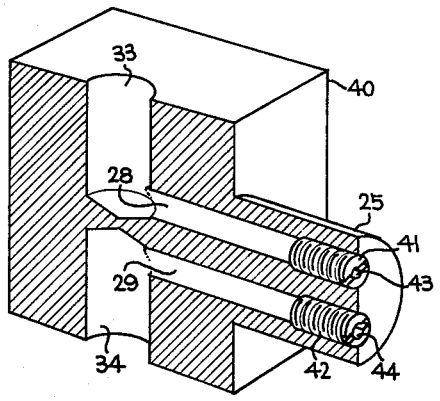
Fig. 4
Fig. 5
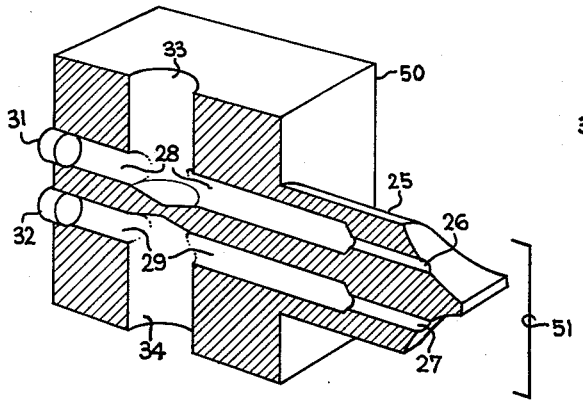
Fig. 6
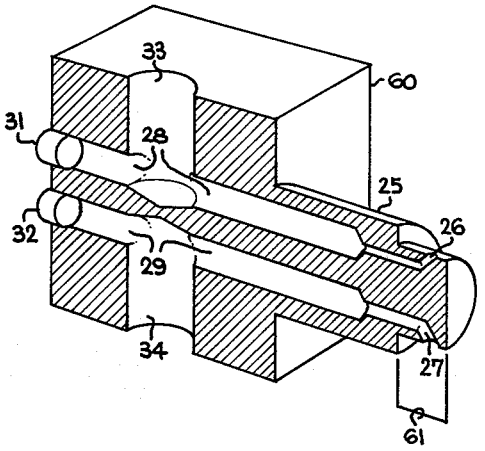

GAS MIXER

BACKGROUND OF THE INVENTION

This invention relates to gas mixers and, in particular, to mixers for forming combustible or explosive mixtures of gases.

Highly combustible mixtures of gases are used in a number of arts for a variety of purposes. As is known, different combinations of gases may be used depending upon the flame temperature desired. One of the hottest flames is obtained from a hydrogen/oxygen mixture. While producing a high flame temperature and being clean burning, this mixture must be carefully controlled.

Prior art mixers are internal mixers, i.e., the gases are mixed in the desired proportion inside the body of the mixer and the mixture fed by suitable conduit to the burner. With this arrangement, destructive flashbacks may occur in which the flame travels back through the conduit to the mixer, occasionally entering the mixer itself. In either event, the flashback is self-sustaining and often destroys the mixer. Aside from the obvious safety problems, flashback often results in appreciable downtime on the production equipment using the burner.

While a number of solutions have been proposed, such as using excess oxygen, running the mixture conduit vertically upward so that the water from combustion tends to extinguish the flame, or increasing the flow velocity of the gases, none has been satisfactory in reducing the incidence of flashback or destructive effects thereof.

SUMMARY OF THE INVENTION

In view of the foregoing, it is therefore an object of the present invention to provide an improved gas mixer.

Another object of the present invention is to provide a flashback tolerant mixer for highly combustible gas mixtures.

A further object of the present invention is to provide an improved gas mixer in which the mixture is formed on a confined portion of the outside surface of the mixer.

The foregoing objects are achieved in the present invention wherein the mixer comprises a block of material nonreactive to the gases to be mixed and having a boss on one planar surface thereof. The mixer body comprises at least two bores extending through said boss. A flexible conduit frictionally engages the boss to define a confined portion wherein gases flowing through said bores mix.

BRIEF DESCRIPTION OF THE DRAWINGS

A more complete understanding of the present invention can be obtained by considering the following detailed description in conjunction with the accompanying drawings, in which:

FIG. 3 illustrates a gas mixer in accordance with the present invention.

FIG. 4 illustrates an alternative embodiment of the present invention.

FIG. 5 illustrates an alternative embodiment of the present invention.

FIG. 6 illustrates an alternative embodiment of the present invention.

DESCRIPTION OF THE PREFERRED EMBODIMENTS

Figure 1:
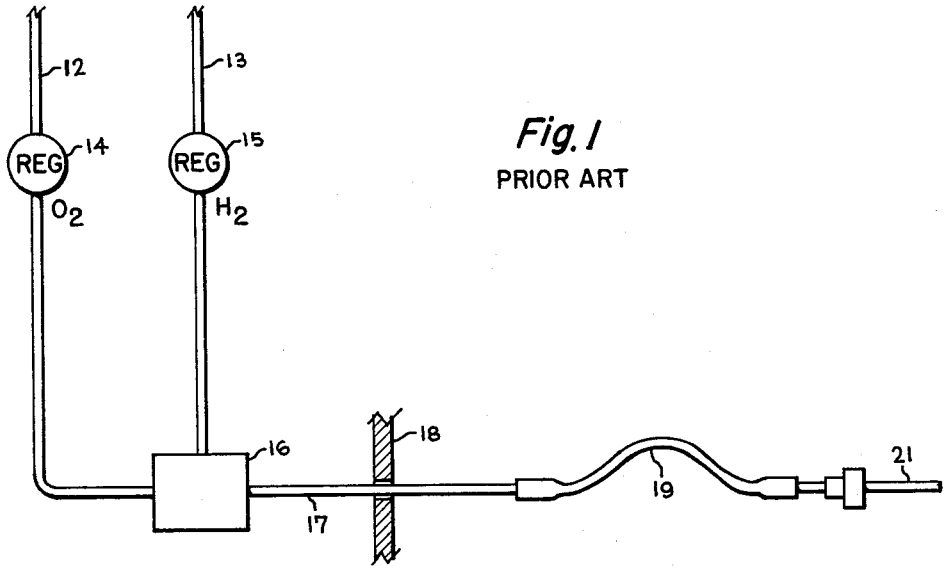
Fig. 1 PRIOR ART
FIG. 1 is a flow diagram for a gas mixer of the prior art.

In the prior art, as illustrated in FIG. 1, the gases to be mixed, such as oxygen and hydrogen, are received from a suitable source of supply by way of lines 12 and 13, respectively. Regulators 14 and 15 control the respective pressures of the oxygen and hydrogen. The gases from regulators 14 and 15 flow to the respective inputs of mixer 16 where the gases are mixed within the mixer body itself. The mixture is then supplied by way of a suitable conduit 17, such as copper tubing, through bulkhead 18 to burner 21 by way of flexible conduit 19, such as rubber hose. If, for reasons that are not fully understood, a flashback should occur, the flame travels from the tip of burner 21 back through conduits 19 and 17 to mixer 16, often entering the interior of mixer 16. During the time it takes to partially disassemble the machinery for access to the gas supplies and mixer, the hydrogen-oxygen flame within mixer 16 is sufficiently hot to melt a portion of the mixer body, which may, for example, comprise brass. Depending upon the extent of the damage, mixer 16 may or may not have to be replaced after each flashback. If the flame should be extinguished, the result may be the accumulation of a hydrogen-oxygen mixture within the enclosure provided for the gas supplies and regulators, as generally indicated by bulkhead 18.

Figure 2:
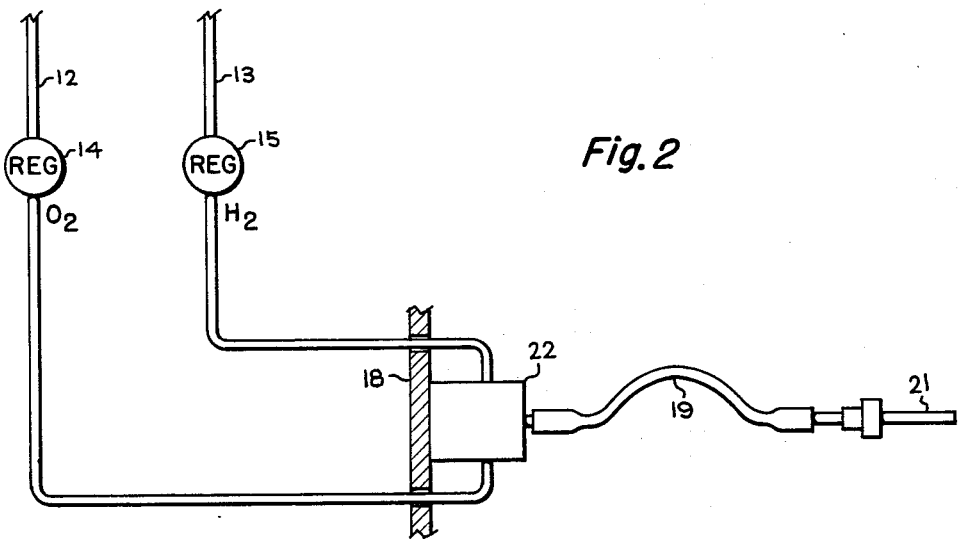
FIG. 2 is a flow diagram of a gas mixer in accordance with the present invention.

In accordance with the present invention, these problems are avoided as illustrated in FIG. 2 wherein supply lines 12 and 13 are connected to regulators 14 and 15 as in the prior art. However, the regulated gas supply is then fed through bulkhead 18 to mixer 22 in accordance with the present invention. As more fully described herein, mixer 22 mixes the gases on a portion of the outside surface thereof in a region enclosed by flexible conduit 19 which is attached thereto. The resultant mixture is fed by flexible conduit 19 to burner 21. In the event of a flashback, the abrupt increase in pressure in conduit 19 causes it to pop off mixer 22, exposing the mixture to the atmosphere in which the flame, if any, is substantially cooler.

FIG. 3 illustrates a preferred embodiment of the present invention wherein mixer 22 comprises a block of suitable material, such as metal, e.g. brass, of any suitable shape. As illustrated in FIG. 3, mixer 22 may have a generally cubical shape having a planar surface 24 on which a boss 25 is formed. Boxx 25 comprises a right circular cylinder which then fits within and frictionally engages flexible conduit 19. Mixer 22 comprises bores 26 and 27 passing therethrough and of a predetermined size depending upon the flow rate and proportion of the mixture. Bores 26 and 27 exit the outermost surface of boss 25, illustrated in FIG. 3 as comprising a plane parallel to planar surface 24. Aligned with bores 26 and 27 are counterbores 28 and 29, respectively, of a suitable larger diameter for adequate flow and ease of coupling to the supply lines. The ends of counterbores 28 and 29 opposite bores 26 and 27 are suitably sealed, for example by plugs 31 and 32, respectively. Coupling to the supply lines from regulators 14 and 15 is provided by suitable bores 33 and 34 which intersect counterbores 28 and 29, respectively. Bores 33 and 34 are shaped and threaded for receiving suitable fittings well known in the art.

In operation, hydrogen gas is supplied through bore 33 to counterbore 28 and 26. Oxygen is supplied through bore 34 to counterbore 29 and bore 27. The mixture of the gases takes place at the outermost surface of boss 25 and is confined to that region by flexible conduit 19 which frictionally engages boss 25. If a flashback does occur, it merely causes the rubber hose to pop off boss 25, exposing both oxygen and hydrogen to the atmosphere where there is no longer an explosive mixture. If a flame should be established at the face of the mixer, it merely burns in the atmosphere without enough heat to destroy the mixer body or allied parts. This result is augmented by orienting the bore containing hydrogen above the bore containing oxygen, as illustrated in FIG. 3.

FIG. 4 illustrates an alternative embodiment of the present invention wherein the metering of the gases is obtained by jets inserted into counterbores 28 and 29 rather than by the size of bores 26 and 27, as illustrated in FIG. 3. Specifically, mixer 40 comprises largely the same structural features as illustrated in FIG. 3 and these features bear the same reference numerals. Counterbores 28 and 29, which need not pass through mixer 40, are suitably threaded at the open end thereof for receiving jets 41 and 42, respectively. These jets, in turn, have calibrated bores 43 and 44 for controlling the mixture proportion of the gases. As is apparent to those of skill in the art, other means may be employed for attaching jets 41 and 42 to boss 25.

FIG. 5 illustrates an alternative embodiment of the present invention wherein boss 25 is terminated at the outermost end thereof by a nonplanar surface 51, illustrated in FIG. 5 as comprising a wedge shape. The wedge shape provides further separation of the gases in the event of a flashback when flexible conduit 19 has separated from boss 25.

FIG. 6 illustrates an alternative embodiment of the present invention wherein mixer 60 likewise contains a number of structural features identical to that of mixer 22 and which bear the same reference numerals. Specifically, in FIG. 6 boss 25 comprises a reduced end portion 61 wherein bores 26 and 27 exit the sides rather than the end of the reduced diameter portion. Flexible conduit 19 fits over the original diameter of boss 25 and frictionally engages boss 25 as before.

There is thus provided by the present invention an improved gas mixer in which combustible or explosive mixtures of gases are formed in a confined area on the outside surface of the mixer. In so doing, the mixer is tolerant of flashbacks and, specifically, can sustain flashbacks without self-destruction.

Having thus described the present invention, it will be apparent to those of skill in the art that various modifications can be made within the spirit and scope of the present invention. For example, depending upon the material and surface characteristics of flexible conduit 19, boss 25 may be provided with ridges to increase the friction between boss 25 and flexible conduit 19. In addition, while described in its preferred embodiment in connection with a mixture of oxygen and hydrogen, it is understood by those of skill in the art that the present invention applies to any mixture of gases, such as gas/air, gas/oxygen, as well as to multiple component mixtures utilizing three or more bores in mixer 22, such as used for gas/oxygen/air. In addition, the mixer jets and mixer blocks can be of any suitable size, depending upon the heat content and temperature of the flame.

What we claim as new and desire to secure by Letters Patent of the United States is:

1. A flashback tolerant mixer for gases comprising:
a block having at least two bores therein; and
pressure sensitive, flexible means, having a single bore and non-threadedly engaging said block, for enclosing the region wherein said bores emerge from said block and wherein said gases mix and for releasing from said block due to the pressure of a flashback.

2. The mixer as set forth in claim 1 wherein said block has a boss through which said at least two bores pass and emerge from said block.

3. The mixer as set forth in claim 2 wherein said boss emerges from a planar surface on said block and comprises a right circular cylinder.

4. The mixer as set forth in claim 3 wherein said boss is terminated by a planar surface parallel to the planar surface of said block.

5. The mixer as set forth in claim 4 wherein said boss contains a reduced diameter portion from which said bores emerge.

6. The mixer as set forth in claim 4 wherein said bores have a reduced diameter in said boss for controlling the flow of gas therethrough.

7. The mixer as set forth in claim 6 and further comprising flexible conduit means frictionally engaging said boss.

8. The mixer as set forth in claim 4 wherein the bores in said boss each have a threaded portion and said mixer further comprises threaded, flow metering jets in said threaded portion.

9. The mixer as set forth in claim 3 wherein said boss terminates in a nonplanar surface.

10. The mixer as set forth in claim 2 and further comprising flexible conduit means frictionally engaging said boss.

* * * * *